United States Patent [19]

Hukamachi

[11] Patent Number: 5,018,541

[45] Date of Patent: May 28, 1991

[54] TOBACCO SUBSTITUTE

[76] Inventor: Etsuko Hukamachi, 6-1-1109, Ohjima, Koto-ku, Tokyo, Japan

[21] Appl. No.: 385,002

[22] Filed: Jul. 25, 1989

[51] Int. Cl.[5] ..... A24B 15/16; A24D 1/18

[52] U.S. Cl. ..... 131/359; 131/369

[58] Field of Search ..... 131/354, 355, 369, 359

[56] References Cited

U.S. PATENT DOCUMENTS 3,136,321 6/1964 Davis ..... 131/355

3,369,552 2/1968 Carrol ..... 131/369

*Primary Examiner*—V. Millin

*Attorney, Agent, or Firm*—Koda and Androlia

[57] ABSTRACT

A tobacco substitute which has a tobacco flavor but contains only an extremely small amount of nicotine, being produced from aloe leaves of about 30×3.5 cm, first cut in approximately 3 cm lengths, then cut finely in the longitudinal direction, placed in water for a very short time, and immediately removed, after which the water may be squeezed out by hand or allowed to drain naturally; dried by spreading out on a basket or a mat for two days in the sun or ten days in the shade if simply rinsed with water, or half a day in the sun if manually squeezed after rinsing; after which a liquid adhesive, such as casein, carragenin, funorin, powdered starch, and the like is blown onto the surface; and finally a powder which is mainly tobacco is blown evenly onto the cut aloe leaves and dried to give a tobacco substitute with a tobacco flavor to which tobacco smokers can easily become accustomed.

1 Claim, No Drawings

TOBACCO SUBSTITUTE

BACKGROUND OF THE INVENTION

1. Field of the Invention

The present invention relates to a tobacco substitute which has a tobacco flavor, but contains only an extremely small amount of nicotine.

2. Description of the Prior Art

As conventional tobacco substitutes there exist materials which are simply plants, such as medicinal plants and the like, which are treated to remove the grassy odor and then dried. These materials have the drawback that the flavor differs from conventional tobacco and the average person cannot become accustomed to this flavor.

SUMMARY OF THE INVENTION

An object of the present invention is to provide, with due consideration to the drawbacks of such conventional materials, a tobacco substitute which, although it has the odor of tobacco, has almost none of tobacco's harmful effects.

This object is achieved in the present invention by the provision of a tobacco substitute for which the main component is aloe.

DETAILED DESCRIPTION OF THE INVENTION

Aloe is a plant which is a member of the lily family. Its leaf has been used from ancient times as an internal medicine for external application for the treatment of illness. In addition, it is effective in beauty culture. Aloe was originally found in the tropical regions where it grows naturally as a pulpy perennial. It grows from 20 cm to 6 meters in height; the leaves are clustered and long and thin; the pulp is thick and contains sap; the rim is spine-shaped, and the tip is pointed. The species which is cultivated in Japan is the Kidachi aloe which has a narrow leaf. The Kidachi aloe is extremely easy to cultivate in a well-drained 50:50 mixture of sand and soil. When a bud taken from a new stalk is grafted it will rapidly multiply. About one month is required from the bud stage until the leaf is large enough for use in the tobacco substitute.

At the present time, aloe is used in many foods, pharmaceuticals, and cosmetics, but, as yet there are no tobacco substitutes using aloe to be found on the market (see the introduction to "Aloe Miracle Medical Remedies," published by Tsuchiya Bookshop).

Accordingly, the inventor of the present invention carried out the following types of experiments to create a tobacco substitute from aloe. The aloe used in these experiment was Kidachi aloe but the present invention is in no way limited to the use of Kidachi aloe.

Aloe leaves suitable for use in a tobacco substitute are those which have grown to a length of 30 cm and width of 3.5 cm approximately. When small leaves are used the resulting tobacco substitute is judged to have a poorer flavor than the substitute made from leaves of the above mentioned size. It is not particularly necessary to wash the leaves with a concentrated saline solution or the like before cutting. All that is required is to simply rinse with water and wipe off the water. Conversely, if the leaves are washed with a concentrated saline solution and rubbed prior to cutting, the leaves become too soft and are difficult to cut. This step is therefore best avoided.

When the leaves are cut they are not cut finely in the lateral direction, but rather it is preferable to first cut them in approximately 3 cm lengths, then cut them finely in the longitudinal direction. If the leaves are finely cut in the lateral direction they have a tendency to curl when they are dried, making it difficult to roll the tobacco substitute into the cigarette paper. When the leaves are cut in the longitudinal direction this problem does not occur; instead, they are easy to light and maintain a flame better. Conversely, laterally cut leaves are intended as a pipe tobacco substitute.

After the leaf has been finely cut, it is placed in water for a very short time, immediately removed, and the water squeezed out by hand. This action results in the leaf drying quickly.

When the leaf is cut, even if thorns remain around the leaf this has no effect on the flavor. However, if the thorns are removed and the leaf is dried, there is no obstacle to crumpling the leaf afterward.

It is unnecessary to remove the jelly-like pulp in the center of the leaf. If the pulp is left attached to the skin of the leaf, the leaf maintains a suitable degree of moisture which gives it a flavor very similar to that of tobacco when it is smoked. If it is particularly desired to use the leaf pulp for another application (such as for medical treatment or beauty culture), the skin and the pulp can be separated and only the skin used as material for the tobacco substitute.

The finely divided aloe leaf is dried which has simply been rinsed with water. A leaf which has been manually squeezed after rinsing with water only takes half a day in the sun to dry. Sun drying is preferable to drying in the shade because it preserves the components of the aloe. If the dried leaf is crumpled by hand, the fiber in the leaf is softened making it easier to roll in paper.

A liquid adhesive is blown onto the surface of the dried aloe leaves produced in this way. Casein, carrageenin, funorin, powdered starch and the like are used as the adhesive, but the usage is not limited to these materials.

After this, prior to drying the adhesive, a powder of which the main ingredient is tobacco is blown evenly onto the aloe leaf, and is dried to adhere to the leaf.

The powder which contains the tobacco, in addition to just tobacco, can also contain a mixture of powdered medicinal plants and the like.

In the foregoing embodiment the aloe leaf is used as the plant material. However, the present invention is not limited to this material. Various types of plants, for example, medicinal plants such as hops and the like, or cherry leaves and the like can be used.

In addition, as a method for causing powdered tobacco to adhere to the plant, the tobacco powder and the adhesive powder may be mixed in advance and blown onto the plant to cause the mixture to adhere. Other methods of adhesion can be considered, but in the final analysis, an adhesion method by which the tobacco powder is not scattered is desirable.

In the case where a medicinal plant is the main ingredient in the present invention with the above mentioned structure, it is possible to obtain the effect of the medicinal plant by introducing it into the body. In the case where non-medicinal plants are used, there is no medicinal effect obtained, but it is possible to reduce the amount of nicotine to an extremely low level.

In addition, because tobacco powder is sprinkled over the tobacco substitute this substitute has a tobacco flavor which tobacco smokers can easily become accustomed to.

Furthermore, the tobacco used in the present invention is in powder form and is not a finely cut material. This is a major feature of the present invention. If fine-cut tobacco is used, when the amount is extremely low the smoke of the tobacco and the plant averages out and a nonuniformity is produced in the unmixed tobacco flavor. If the amount of fine-cut tobacco is increased, the amount of nicotine is also increased, which is a problem as far as health is concerned. In the present invention, the tobacco is in powdered form, so even if the amount is kept low, because it is sprinkled evenly on the medicinal plant, when the product of the present invention is smoked the tobacco flavor is uniform giving the effect of savoring the tobacco flavor, in spite of the small amount of actual tobacco. Furthermore, the powdered tobacco is secured to the medicinal plant by the adhesive so the effect is provided whereby there is no fear of the powdered tobacco scattering and being inhaled into the lungs.

I claim:

1. A tobacco substitute consisting of:

a finely cut and dried non-tobacco plant material consisting of aloe; and a powder containing at least tobacco sprinkled on and adhered to a surface of said finely cut and dried non-tobacco plant material.

* * * * *